US006020578A

United States Patent [19]

Putz

[11] Patent Number: 6,020,578

[45] **Date of Patent: *Feb. 1, 2000**

[54] ELECTRIC HEATING ELEMENT AND METHOD FOR PREPARING THE SAME

[75] Inventor: Anton Putz, Ebensee, Austria

[73] Assignee: A.u.A. Putz Gesellschaft mbH & Co. KG, Ebensee, Austria

[ * ] Notice: This patent issued on a continued prosecution application filed under 37 CFR 1.53(d), and is subject to the twenty year patent term provisions of 35 U.S.C. 154(a)(2).

[21] Appl. No.: 08/809,029

[22] PCT Filed: Jul. 27, 1995

[86] PCT No.: PCT/EP95/02992

§ 371 Date: May 30, 1997

§ 102(e) Date: May 30, 1997

[87] PCT Pub. No.: WO97/02854

PCT Pub. Date: Jan. 30, 1997

[30] Foreign Application Priority Data

Sep. 29, 1994 [DE] Germany ..... 44 34 956

[51] Int. Cl.[7] ..... H05B 3/34

[52] U.S. Cl. ..... 219/545; 219/529

[58] Field of Search ..... 219/528, 529, 219/545, 548, 549, 211, 212; 28/140, 142, 155, 156, 165, 166; 57/243, 244, 245

[56] References Cited

U.S. PATENT DOCUMENTS

| | | | |
|---|---|---|---|
| 1,703,005 | 2/1929 | Hewitt | 219/545 |
| 2,396,099 | 3/1946 | Hartwell | 219/545 |
| 2,670,620 | 3/1954 | Goldstaub | 219/545 |
| 2,797,296 | 6/1957 | Fowler et al. | 219/545 |
| 2,922,867 | 1/1960 | Crump | 219/545 |
| 2,967,415 | 1/1961 | Ford et al. | 219/545 |
| 3,448,573 | 6/1969 | Glen et al. | 28/166 |
| 3,472,289 | 10/1969 | Webber et al. | 219/545 |
| 3,748,844 | 7/1973 | Pacofsky | 57/272 |
| 4,143,197 | 3/1979 | Jasionowicz et al. | 28/167 |
| 4,876,774 | 10/1989 | Kavesh et al. | 28/166 |
| 5,484,983 | 1/1996 | Roell | 219/545 |

FOREIGN PATENT DOCUMENTS

| | | |
|---|---|---|
| 0532468A1 | 9/1992 | European Pat. Off. . |
| 867263 | 2/1953 | Germany . |
| 1186157 | 1/1965 | Germany . |
| 3416596 A1 | 12/1984 | Germany . |
| 1166480 | 9/1989 | Japan . |
| 1507973 | 4/1978 | United Kingdom . |

OTHER PUBLICATIONS

Database WPI Week 8530 Jun. 18 1985 Derwent Publication Ltd., London, GB; AN–85–181952 and JP–A–60–111653.

Kellenberg, German Magazine *Elektrizitatsverwertung*, JG. 52 (1977) Nr. 3 "Elektrische Grossflachen–heizungen mit Heizmatten", pp. 52–54.

C.D. Claassen, "Heat Tracing of Process Piping by means of Self–Regulating Heating Tapes and Temperatures and Leakage Monitoring", 3R International, Jahrgang, Heft 7, Jul., 1985, pp. 387–392 (German article).

*Primary Examiner*—Sang Paik

*Attorney, Agent, or Firm*—Haugen Law Firm PLLP

[57] ABSTRACT

An electric heating element, such as in a tape, web or mat-shaped configuration which includes a mesh-shaped electrical conductor arrangement with at least one wire extending in a mesh shape and being uninsulated in order to produce contact points between a plurality of individual meshes. Additionally, the mesh-shaped wire arrangement is provided with at least one further carrier component holding the individual meshes of wire in a defined location or position so as to insure multiple contact between individual meshes. The carrier component extends in parallel side-by-side relationship with the wire to form the mesh-shaped electric conductor arrangement.

20 Claims, 2 Drawing Sheets

ELECTRIC HEATING ELEMENT AND METHOD FOR PREPARING THE SAME

The invention relates to an electric heating element, in particular in the form of a tape, web or mat-shaped electric heating element, having an electric line arrangement provided therein, and to an associated method for preparing the same.

Large-area electric heaters using heating mats have been disclosed, for example, by the journal "Elektrizitätsverwertung" [Making use of electricity], Volume 52 (1977), No. 3. This known heating mat comprises a resistance conductor having a plurality of wires, over which an insulating sheath having long-term resistance to heat is applied. Over this there is a covering of heat-stabilizing PVC. These heating loops are covered with a film made of thermoplastic in the vacuum deep drawing process. As a result, the heating conductors are fixed at the necessary spacings. Heating mats with PTC resistor connections on one or both sides are provided.

Heating mats of this type can be used, for example, as floor heaters or free surface heaters.

Trace heating of process pipelines using self-regulating heating tapes has been also disclosed, for example, by the journal "3R international", Volume 24, Issue 7, July 1985. In this case, this concerns a so-called self-regulating heating tape, which is composed of a semiconductive plastic tape into which two parallel-guided copper stranded wires are inserted at a spacing of 5 to 15 mm. The semiconductive plastic is electrically insulated by a polyolefin or by a fluoropolymer.

Depending on the field of use, the heating tape is additionally provided with a metallic protective braid and/or an additional plastic covering. The semiconductive plastic tape forms the heating element. It is composed of a graphite-filled, radiation crosslinked polyolefin, fluoropolymer or similar material. The proportion and distribution of the graphite determine the electrical resistance. It rises sharply with increasing temperature, that is to say the tape has a positive temperature coefficient (PTC). The heating tape therefore regulates its emitted heating power via its temperature-dependent resistance at each point of the pipework (irrespective of the position of the sensor of the thermostat), depending on the local circumstances.

It is the object of the present invention to provide an electric heating or thermal element, as well as a method for producing the same, which in principle can be configured to be flat in different size dimensions, and which at the same time is also simple to produce in terms of production technology. The heating element is intended at the same time to have beneficial electrical properties for use as a heating and thermal element.

According to the invention, the object is achieved with respect to the thermal or heating element according to the features specified in claim 1, and with respect to the method for its production according to the features specified in claim 15. Advantageous embodiments of the invention are specified in the subclaims.

Using the present heating or thermal element according to the invention, a completely novel route is being pursued.

In the case of the electric heating or thermal element according to the invention, to be specific the at least one wire used is present in the form of a mesh product. The type and form of this mesh product can be selected in a completely diverse manner. For example, production on weaving, braiding or Raschel machines is possible. Likewise, fully diverse types of construction of the meshes are possible. However, it is furthermore provided according to the invention that the mesh-shaped electric wire conductor, which is not provided with any insulating covering (in order that the meshes can form multiple electrical contact with one another), are [sic] incorporated in a shrinkable bond or composite.

This additionally provided, shrinkable composite material ensures that, by means of the shrinking provided according to the invention, the individual wires, that is to say the individual mesh wires, are pressed against one another. As a result, a specific comprehensive contraction of the individual wire-shaped meshes with one another is ensured, with the result that a largely regular current flow through this mesh product can be ensured (in the case of irregular arrangement of the wire, burning out or burning away of the wire at various points could occur on account of excessively high current intensities, whereas at other points the mesh-shaped wire present under certain circumstances hardly heats up at all, since the resistance at the various points is otherwise irregular.

In a preferred embodiment of the invention, a textile shrinkable yarn is used as mesh-shaped composite material. The heating or thermal element according to the invention therefore consists in a preferred embodiment of a mesh product in which at least one electrical wire conductor, at least one textile shrinkable yarn has been knitted, woven, braided etc., to form a common composite mesh product.

By means of appropriate material-dependent heating of the composite material (in the case of a textile shrinkable yarn made of polyimide, to over 300°, for example, in particular 330° C.), the desired shrinkage of the flat heating or thermal element, which is prefabricated and in the form of a mesh product, by about 20% is brought about, as a result of which at the same time reinforcement of the tape as compared with the initial mesh product is achieved. In this shrunken overall composite, the individual meshes formed from the at least one electric wire are now held in a desired connection in relation to one another, in which the individual machine loops of the wire have multiple contact with a neighboring wire loop.

However, it can be noted as particularly surprising that, in the case of an electric heating element according to the invention, the desired ohmic resistance value can be set comparatively without problems to be different.

Thus, for example in a preferred exemplary embodiment of the invention, it is possible for the electric heating element produced in the form of a knitted tape to have a resistance value of 19 Ω/m in the raw state. This value can be altered depending on the tension (expansion) in the width and longitudinal direction, depending on the desired requirements. During the shrinking procedure under the influence of heat (generally in an oven), by setting a specific pressure and tension (in the transverse and/or longitudinal direction) and as a function of the residence time in the heating oven, the resistance value of the tape can be set, for example, to a value from 1 Ω/m to 50 Ω/m. Following the heating and shrinking of the electric heating element, the appropriate resistance value (Ohm value) is then stable and can no longer be altered (unless the heating element is severely mechanically loaded, for example kinked, etc.).

The heating or thermal element according to the invention is, however, distinguished by a further completely surprising effect. If, for example, an electric mesh-shaped heating element has a resistance value of 2.4 Ω/m, and if using this, for example, a two meter long tape is divided in the longitudinal direction into two parts, each one meter long, then the resistance value in each tape increases to, for example, 3.7 Ω/m.

Furthermore, it is surprising that the resistance value (Ohm value) does not increase linearly with increasing tape length. If, for example, an electric heating element according to the invention and one meter long has a resistance value of 2.5 Ω, then by contrast a 20 meter long electric heating element (given otherwise identical construction as in the first case) yields a resistance value of only 30 Ω. In the case of a 20 meter long tape one would expect a resistance value 20 times as large, namely 50 Ω.

It is just the last-mentioned effect which offers the significant advantage that the heating elements according to the invention can be configured to be of comparatively large area and, above all, comparatively long, in order always to achieve heating powers which are still optimal, since the resistance value does not rise linearly.

The electric heating or thermal element according to the invention can be operated both using high voltage and with low voltage, it being possible to operate with direct or alternating voltage.

An exemplary embodiment of the invention is explained in detail below making reference to drawings, in which, in detail:

The electric, tape-shaped heating element 1 which is explained using the drawings, is, for example, knitted on a knitting machine having a gauge of 8 (ne 8=8 needles per inch imperial) in a knitted construction with a tuck on both sides.

In this case, a textile yarn 3 made of polyimide having a fiber diameter equivalent to a metric count of 16 and an electric line wire 5 that is to say in the exemplary embodiment shown a thin resistance wire of 0.12 mm diameter consisting of a copper/nickel alloy with a resistance value of 35.37 Ω/m is knitted.

Figure 1:
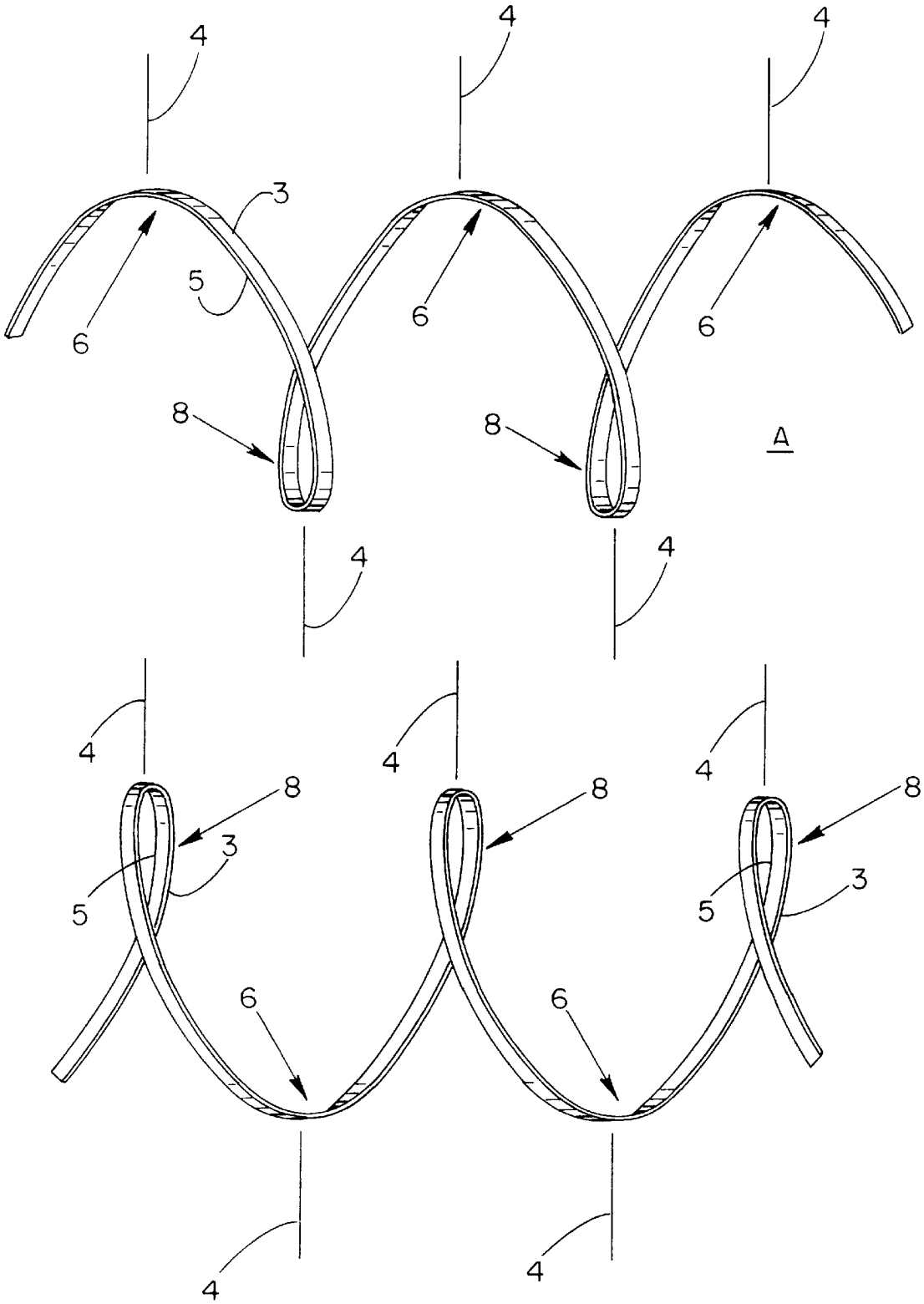
FIG. 1 shows a schematic representation of the detail of the course of the mesh of an electric heating tape according to the invention.
Figure 2:
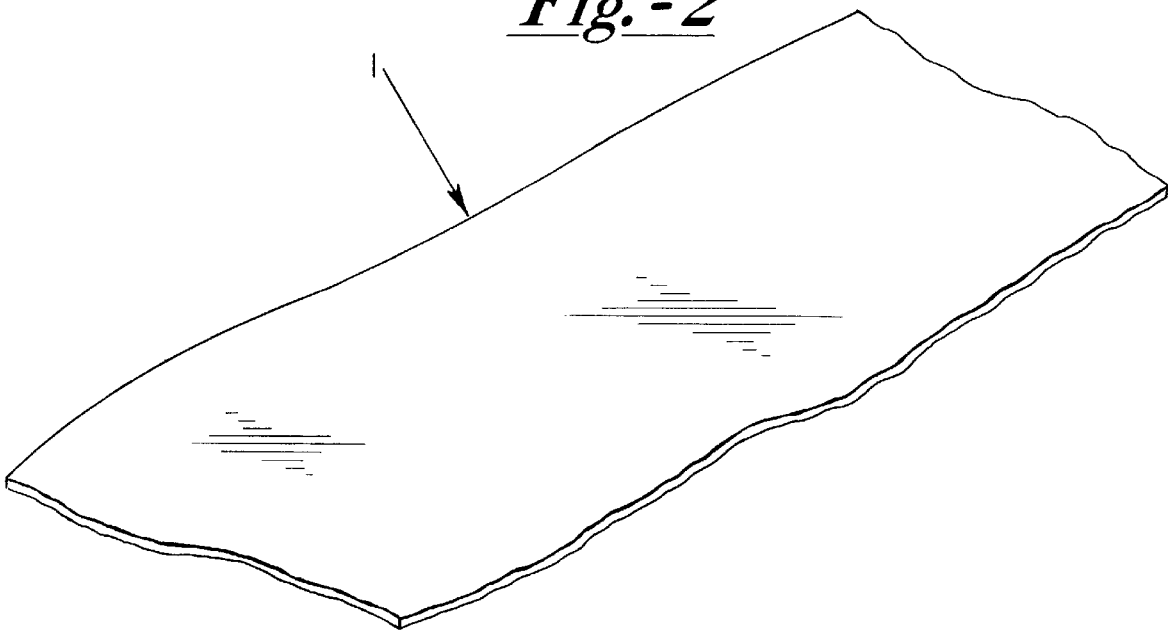
FIG. 2 shows a schematic representation of the tape-shaped electric heating element in the raw state.
Figure 3:
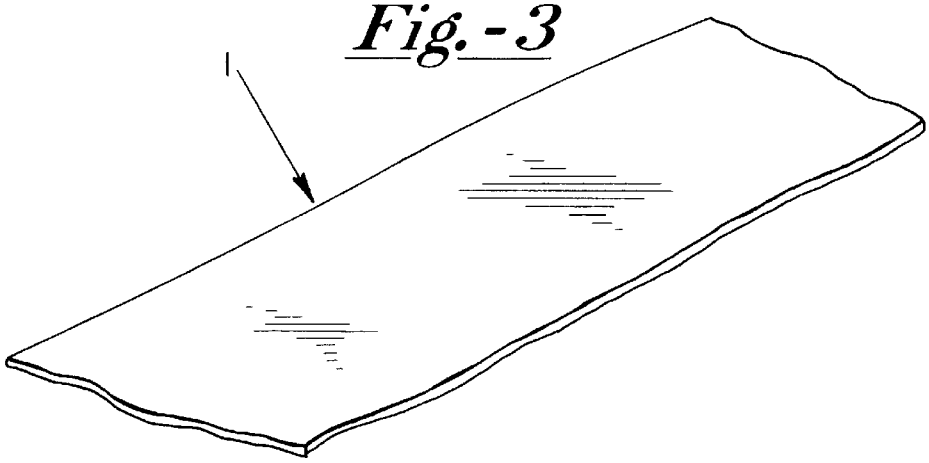
FIG. 3 shows a schematic representation of the electric tape-shaped heating element following the shrinking procedure.

The double tuck knitted construction is shown schematically using FIG. 1, to be specific using the so-called first and second row A and B. In each case the textile yarn 3 and the conductor wire 5 are knitted in parallel, side by side relationship and continuously via the needles 4. In row A, the so-called "tuck 6" is knitted on the rear needles 4 and the so-called "loops 8" are knitted on the front needles.

In the second row B, the "loops 8" are in turn knitted on the rear needles 4and the "tuck 6" is knitted on the front needles 4.

As a result of continuous knitting in the "tuck" knitting construction described, the so-called "wales" are produced and hence the rib structure of the heating tape.

According to the knitted tape-shaped resistance element produced using the data which can be seen in the table appended at the end, [lacuna] thereafter comprises, for one meter tape length, 305 meters resistance wire and 305 meters textile yarns, polyimide yarns in the present case.

The tape coming from the knitting machine has a width of, for example, 7.5 cm. In the raw state, it has a resistance value of 19 Ω/m.

The corresponding tape-shaped electric thermal or heating element is led batchwise or continuously through a heating or shrinking oven which, in the exemplary embodiment shown, is heated as a function of the textile yarn used to a temperature value at which the textile yarn can shrink. In the exemplary embodiment shown, a shrinking temperature of 330° C. is selected.

During the shrinking procedure in the heating or shrinking oven, the tape-shaped heating element can be held in the longitudinal and/or transverse direction by means of suitable measures and subjected to tension, in order therefore to introduce appropriate tensile forces in the longitudinal and/or transverse direction into the tape-shaped electric heating element. Depending on these different tensile forces, a different resistance value, which depends thereon, of the finished tape-shaped electric heating element can be set. The final resistance value additionally depends also on the total time of the shrinking procedure, that is to say the residence time in the heating oven.

As a result of the shrinking procedure, the electric tape-shaped heating element which, in the raw state, has a width of, for example, 7.5 cm, is shrunk to a width of 5.5 cm.

While the heating element is comparatively soft in the raw state, depending on the thicknesses of the resistance wire used and of the textile yarn used (also similar to other textile fabrics), by contrast the shrunken tape-shaped heating or thermal element has a certain stiffness, but can equally well still be bent, in particular wound up into rolls.

As a result of the shrinking procedure, the wires which are present in a mesh shape are pressed against one another such that a multiple contact is produced between the individual wire meshes and neighboring wire meshes. As a result of the shrinking forces, the wire meshes (which indeed cannot shrink, by contrast with the textile yarns) are held in a desired, predefined contact position in relation to one another. This ensures that the contact of the wires follows a specific scheme and system, in order to ensure a comparatively regular current flow through the entire tape width in the flow direction. This also avoids the situation that, in the case of an irregular wire arrangement with irregular contacts and wires in relation to one another, under certain circumstances, on account of excessively high current intensities at individual points, cooling or burning away of the wire can otherwise take place, and that at other points the wire hardly heats up at all, since the individual meshes under certain circumstances have no contact with one another.

Figure 4:
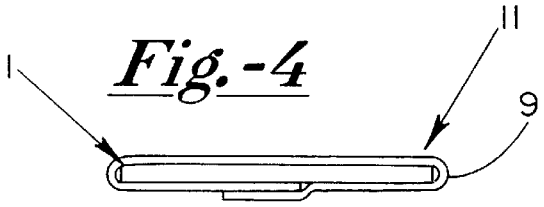
FIG. 4 shows a schematic cross-sectional representation through the finished electric tape-shaped heating element, including a protective covering surrounding the tape.

Depending on the use, the shrunken tape-shaped heating or thermal element in the exemplary embodiment shown, having a width of, for example, 5.5 cm (by contrast with a width of probably 7.5 cm before shrinking), can be produced in any arbitrary length and wound up into rolls. It can be cut to length on site by means of cutting into any arbitrary length. As required, the tape can further be welded into a protective covering, shown in FIG. 4, made for example from PFT plastic material 9 (in FIG. 4, the ends of the narrow plastic web running in the longitudinal direction are laid over each other at 11 and welded to each other in the longitudinal direction of the tape-shaped electric thermal element). At the same time, this plastic covering offers insulating protection for uses in which a non-conductive insulating covering is required. The welding to the insulating covering is preferably carried out before winding up the tape-shaped heating and thermal element to form the final bales ready for sale.

As can be seen from the table reproduced further below at the end, different resistance values can be set by means of appropriate selection of the material density, cross-sectional areas and composition of the electric resistance wire and of the textile yarn, the type and density of mesh used, that is to say in particular using the different knitting constructions, and with regard to the tensile stresses, which can be set differently, in the transverse and longitudinal direction of the tape-shaped resistance element before and during the shrinking procedure.

In the exemplary embodiment shown, a tape-shaped resistance element is described which, following the shrinking procedure, has the data which can be seen from the table, that is to say in particular a resistance value of 2.4 Ω/m.

If such a tape having a width of 5.5 cm is severed in the longitudinal direction into two equally long tape-shaped heating elements having a width of only 2.75 cm in each case, then the resistance value of each tape is increased in a surprising way to 3.7 Ω/m.

However, it is still more surprising that the resistance value does not increase linearly with increasing tape length. A tape-shaped heating element one meter long according to the production data which can be seen from the table has, for example, a resistance value of 2.5 Ω. However, a resistance element 20 meters long produced under the same conditions has by contrast a resistance value as a whole of not 50 Ω but only about 30 Ω.

For test purposes only, it has for example been attempted, in the case of a tape-shaped heating element produced in this way, subsequently to remove the textile material once more (by separating it). The result of this was that the resistance value of the tape, which in the finished state before removal of the textile material still had a resistance value of 2.4 Ω/m, suddenly has a resistance value of 45 Ω/m. It can be seen from this that the shrinkable textile material, which is likewise present in mesh form, has a decisive influence on the actual resistance of the mesh-shaped wire.

The heating or thermal element can be operated in use both using raw [sic] voltage and low voltage and hence be heated up. Direct or alternating voltage can be applied.

The exemplary embodiment has been described for the case of a tape-shaped resistance element. However, it is equally possible to produce large-area film-like, in particular mat-like heating elements. There is no limitation of the size in the longitudinal or transverse direction.

Under certain circumstances it is also possible for a heating and thermal element comprising a plurality of layers, that is to say a plurality of mesh layers in the thickness direction, to be produced and used.

Finally, an embodiment is also conceivable in which the tape-shaped electric heating element has in its central region a mechanical isolation or insulation (that is to say here, if necessary, the electrical wires are interrupted), the halves of the tape thus produced and not in electrical contact being bridged at one of their ends by means of an electrical link in such a way that the linking of the electrical connection can take place at the opposite end. It is then possible to connect the positive pole to one half of the tape and, for example, to connect the negative pole to the other half of the tape at the so-called "cold points" located adjacent to one another there.

The electrical heating or thermal element, in particular the tape, web or mat-shaped or similarly formed electrical heating or thermal element, which is composed of a mesh product, is on the one hand formed using one or more wires and on the other hand using one or more textile yarns (3) as emerges from the abovementioned exemplary embodiments. In this case, the heating or thermal element according to the invention is distinguished by the fact that the textile yarn (3) or the textile yarns (3) is or are composed of a shrinkable material, and that the heating or thermal element is produced by shrinking the mesh product comprising the electric resistance wire (5) or the electric resistance wires (5) and the textile yarn (3) or yarns (3).

TABLE

| | | Exemplary embodiment | Possible ranges |
|---|---|---|---|
| Mesh wire | diameter | 0.12 mm | any which can be processed1 e.g. 0.01–1 mm ( . . . 0.02–0.5 mm) |
| | material | Cu/Ni alloy | diverse (other resistance wires can also be used) |
| | property | 35.36 Ω/m | diverse, depending on material |
| Textile yarn | diameter | metric count 16 | any which can be processed |
| | material | polyimide | generally shrinkable |
| | property | shrinkable at T ≧ 330° C. | any, depending on material |
| Electric heating element in raw state | tape width | 7.5 cm | any |
| | mesh type | knitted | any (e.g. produced on knitting, weaving, braiding or raschel machines |
| | knitted construction | with a tuck on both sides | any |
| | gauge of the knitting machine | 8 (Nm 8 = 8 needles per inch imperial | any |
| | material density | 305 m wire/m 305 m polyimide yarns/m | any |
| Electric heating element in raw state | number of rows of loops | 39 loops in 10 cm | any, e.g. more than 2 and less than 100 loops in 10 cm |
| | number of wales | 5 | any, e.g. more than 2 and less than 100 wales |
| | resistance value | 19 Ω/m | any |
| Electric heating element in shrunken final state | shrunk at shrinking temperature | 330° | any, depending on material |
| | transverse tensile force | any, providing no destruction | any, providing no destruction |
| | longitudinal tensile force | any, provided no destruction | any, provided no destruction |
| | residence time in shrinking oven | about 5 s | may be selected |
| | tape width following shrinking | 5.5 cm | depends on degree of shrinkage, generally more than 10%, preferably more than 20%, of the initial product |
| | resistance value of tape of 1 m length | 2.4 Ω/m | any, within wide ranges, e.g. O.5 Ω/m to 50 Ω/m |
| Electric heating element in shrunken final state | resistance value of 1 m long tape following longitudinal division into two tapes | 3.7 Ω/m | — |
| | resistance value of tape of 20 m length | 30 Ω | — |

TABLE-continued

| | Exemplary embodiment | Possible ranges |
|---|---|---|
| resistance value following partial removal of the textile material | 45 Ω/m | — |

I claim:

1. Electric heating or thermal element, in particular tape, web or mat-shaped or similar electric heating or thermal element, which comprises a mesh-shaped electric conductor arrangement, characterized in that at least one wire of the conductor arrangement runs in segments of a mesh-shate configuration consisting of a substantially continuous series of interwoven tuck loops forming the mesh and the segments comprising the loops of wire are uninsulated in order to produce contact points between a plurality of individual meshes, and in that in addition to the mesh-shaped wire arrangement there is provided at least one further carrier component for each of the said at least one wire which holds the individual meshes of the wire segments in a defined position ensuring multiple contact between individual meshes, with the at least one further carrier component running in parallel, side-by-side relationship with said at least one mesh wire to form the mesh-shaped electric conductor arrangement.

2. Electric heating or thermal element according to claim 1, characterized in that the further carrier component is composed of a shrinkable material and in a shrunken state holds the mesh-shaped wires (5) in a predefined contact position of the individual meshes in relation to one another.

3. Electric heating or thermal element according to claim 1 or 2, characterized in that the further carrier component is composed of a textile yarn (3).

4. Electric heating or thermal element according to claim 3, characterized in that the at least one electric wire (5) and the at least one textile yarn (3) is produced in the manner of a knitted construction, a woven construction, a braided construction and/or a so-called Raschel construction.

5. Electric heating or thermal element according to claim 3, characterized in that the textile yarn (3) is composed of shrinkable polyimide which is shrinkable from a temperature of more than 300° C. and up to about 330° C.

6. Electric heating or thermal element according to claim 3, characterized in that the textile yarn (3), composed in particular of polyimide, has a cross section equivalent to a metric count of about 16/1.

7. Electric heating or thermal element according to claim 1, characterized in that it is knitted using a knitted construction with a tuck on both sides.

8. Electric heating or thermal element according to claim 7, characterized in that for each row of loops at least five wales per 10 cm width are provided.

9. Electric heating or thermal element according to claim 8, characterized in that for each row of loops up to 300 are provided.

10. Electric heating or thermal element according to claim 9, characterized in that for each 10 cm up to 80 rows of loops are provided.

11. Electric heating or thermal element according to claim 10, characterized in that for each 10 cm from between about 35 up to about 45 rows of loops are provided.

12. Electric heating or thermal element according to claim 1, characterized in that the conductive wire (5) has a diameter of from between about 0.03 to about 0.5 mm.

13. Electric heating or thermal element according to claim 12, characterized in that the conductive wire (5) has a diameter of less than about 0.5 mm.

14. Electric heating or thermal element according to claim 1, characterized in that the electrically conductive wire (5) is composed of a copper/nickel alloy.

15. Electric heating or thermal element according to claim 14, characterized in that a heating or thermal element with a length which is X times longer than an otherwise identically produced shorter heating and thermal element rises by the factor "X*F", the factor F having values below 0.9, preferably below 0.8, below 0.7, in particular below or equal to 0.6.

16. Electric heating or thermal element according to claim 1, characterized in that the resistance value in a current passage direction rises less than proportionally as a function of the length thereof.

17. Method for the production of an electric heating or thermal element according to claim 7, characterized in that the heating or thermal element is produced by stretching, weaving, braiding or by being produced on a Raschel machine or by processing one or more electric wires and one or more textile shrinkable yarns in such manner that the wire and the textile shrinkable yarn run in a parallel, side-by-side manner, wires without a protective covering being used.

18. Method according to claim 17, characterized in that the heating or thermal element is heated to a shrinkage temperature at which the textile yarns shrink.

19. Method according to claim 18, characterized in that during the shrinking procedure, tensile forces are exerted on the heating or thermal elements in the longitudinal and/or transverse direction, in order to set different resistance values.

20. Method according to claim 19, characterized in that the shrinking procedure is carried out in such a way that a shrinkage in the longitudinal direction and/or the transverse direction of at least 10%, preferably at least 20%, is achieved.

* * * * *

UNITED STATES PATENT AND TRADEMARK OFFICE

CERTIFICATE OF CORRECTION

PATENT NO : 6,020,578

DATED : February 1, 2000

INVENTOR(S) : Anton Putz

It is certified that error appears in the above-identified patent and that said Letters Patent is hereby corrected as shown below:

Column 7, line 18, "mesh-shate" should read -- mesh-shape --.

Column 8, line 33 (Claim 17), the dependency should read -- claim 1 --.

Signed and Sealed this

Third Day of October, 2000

*Attest:*

Q. TODD DICKINSON

*Attesting Officer*

*Director of Patents and Trademarks*